US005568130A

United States Patent [19]

Dahl

[11] Patent Number: 5,568,130

[45] Date of Patent: Oct. 22, 1996

[54] FIRE DETECTOR

[76] Inventor: Ernest A. Dahl, 3247 Breaker Dr., Ventura, Calif. 93003

[21] Appl. No.: 312,946

[22] Filed: Sep. 30, 1994

[51] Int. Cl.[6] ..... G08B 17/10

[52] U.S. Cl. ..... 340/630; 340/628; 340/555; 250/574

[58] Field of Search ..... 340/630, 555, 340/629, 632, 628; 250/574

[56] References Cited

U.S. PATENT DOCUMENTS

| | | | |
|---|---|---|---|
| Re. 32,105 | 4/1986 | Enemark | 340/630 |
| 3,882,477 | 3/1973 | Mueller | 340/630 |
| 3,994,603 | 2/1975 | Paschedag | 356/438 |
| 4,021,792 | 6/1975 | Ludt et al. | 340/630 |
| 4,025,915 | 10/1975 | Enemark | 340/630 |
| 4,185,278 | 9/1977 | Lintelmann et al. | 340/630 |
| 4,288,790 | 1/1980 | Schnell | 340/630 |
| 4,321,466 | 3/1982 | Mallory et al. | 340/630 |
| 4,420,746 | 12/1983 | Malinowski | 340/630 |
| 4,430,646 | 2/1984 | Enemark | 340/630 |
| 4,700,079 | 10/1987 | Ito | 250/574 |
| 4,845,474 | 7/1989 | Moore et al. | 340/629 |
| 5,103,096 | 4/1990 | Wong | 250/343 |
| 5,229,610 | 2/1992 | McNeil et al. | 250/308 |
| 5,237,308 | 2/1992 | Nakamura | 340/630 |
| 5,420,440 | 5/1995 | Ketler et al. | 340/630 |
| 5,420,567 | 5/1995 | Schwarz | 340/630 |
| 5,451,931 | 9/1995 | Muller et al. | 340/630 |

*Primary Examiner*—Jeffery Hofsass
*Assistant Examiner*—Davetta C. Woods
*Attorney, Agent, or Firm*—Howard Kaiser

[57] ABSTRACT

An apparatus for detecting fire including a light source for generating light, a light sensor for receiving light from the light source and providing an analog signal representing the intensity of the received light, and a clear plastic light guide for transmitting the light from the light source to the sensor. The light guide include notches for allowing smoke to enter the notches. Smoke entering the notches decreases the intensity of the light passing therethrough. A calibration sensor is included. The sensitivity of the fire detector is increased by a lens assembly which collimates the light generated by the light source. The color of smoke entering the light guide may be determined by generating colored light. Temperature, humidity and carbon monoxide levels are also detected and the information is integrated with the smoke detection data to provide a reliable fire detector.

20 Claims, 2 Drawing Sheets

FIRE DETECTOR

The invention described herein may be manufactured and used by or for the Government of the United States of America for governmental purposes without the payment of any royalties thereon or therefor.

BACKGROUND OF THE INVENTION

1. Field of the Invention

The present invention relates to the detection of fires and, more specifically to a detector which relies upon the optical interference of smoke across or within a light beam, determining the amount of smoke, the rate of change in the amount of smoke, the color of the smoke, and other information associated with fires, including temperature, humidity and carbon monoxide levels. By combining monitored levels of CO, temperature and humidity, advanced prediction of fire conditions is possible.

2. Description of the Related Art

Prior fire detection systems are based either on electrical current continuity, in which smoke from a fire reduces a current flow and trips a relay giving a yes or no signal as to the presence of smoke, such as an ionization-type detector, or on the optical blockage of light, which again indicates the presence of smoke, but not an amount or a rate of change in the form of analog information. In addition, these systems have no way of integrating smoke detection with other information related to fires, such as humidity, temperature, and carbon monoxide levels. As a result, prior art systems generate false alarms, and are unable to predict an impending fire situation.

SUMMARY OF THE INVENTION

The present invention overcomes the above-noted deficiencies of the prior art by providing an improved apparatus for detecting fire, which includes a light source for generating light, a light sensor for receiving light from the light source and measuring a sampled intensity of light, and a light guide for transmitting generated light from the light source to the light sensor. The light guide includes notches across which transmitted light passes and into which smoke is allowed to enter, such that smoke entering the notches decreases the intensity of light passing therethrough. Changes in light intensity are detected by a sensor, which generates an analog signal available for further processing.

The fire detector also includes a calibration sensor for receiving and measuring light generated by the light source, such that the initial intensity of light measured by the calibration sensor can be used for determining the operating condition of the detector, and for calibrating the light sensor, for example, by comparison of the initial intensity to the sampled intensity.

Various types of light can be generated by the light source, including infrared light and visible light. In addition, the light source can be powered by, for example, a DC power source, whereby a steady light beam will be generated, or pulsed power can be used, whereby a pulsed, light beam output will result.

In a particular embodiment of the fire detector of the present invention, the light guide is made of clear plastic, and has first and second ends, the light source and the sensor being located at the first end, and the second end having reflective surfaces for reflecting generated light transmitted along one side of the light guide from the light source at the first end back along the other side of the light guide to the light sensor located again at the first end. Using this arrangement, the distance through which generated light is transmitted by the light guide is increased. Of course, additional reflectors could be used to increase the length of the light path.

The present invention takes advantage of the longer light path by providing a number of notches along the length of the light guide through which passes the generated and reflected light.

The notches can be of various shapes, including notches with either angular or parallel sides. Further, detector sensitivity can be increased by adding collimating lens-assemblies to focus the light into parallel rays for transmission by the light guide. Advantageously, pairs of collimating lenses can be mounted or formed in either side of the smoke-admitting notches.

Fire detection may be based on a rate of change in smoke intensity as related by the detector. This capability allows for placement of the fire detector in various environments, including those that may have a higher ambient level of air impurity, such as a machine room or a kitchen.

Further, the fire detector can be equipped to detect the color of smoke entering the apparatus by coloring the light generated by the light source. Colored light can be generated either by using a colored light source, or by placing colored lenses between the white light source and the detector. The detector can measure the intensity of colored light received, and determine the color of smoke.

Other data provided by the fire detecting apparatus can be integrated with the smoke information to portray more completely a potential fire situation and to reduce the occurrence of "false positive" alarms. Relevant information includes relative humidity, ambient temperature, and carbon monoxide (CO) levels. Appropriate electronic detectors of a known type are mounted on the end of the light guide or within a detector housing. Thus, rate of change in smoke levels can be correlated with information from other fire detectors, as well as with data regarding, for example, temperature, relative humidity, and CO concentration, to provide a more reliable and detailed basis for making a fire determination. In addition, the detector can be incorporated into a monitoring system, such as the TWARSES (Two Wire Automatic Remote Sensing Evaluation System) currently under development by the U.S. Navy, to increase the capabilities thereof.

Other advantages of the detector include smaller physical size, and greater airflow, which is achieved because smoke need not enter an enclosed portion of the probe. The shape of the detector, for example, allows for the simple insertion of the detector into a container, for example for storage of munitions or missiles, such that interior conditions can be monitored from outside the storage facility.

Other features and advantages of the present invention will become apparent from the following description of the invention which refers to the accompanying drawings.

DETAILED DESCRIPTION OF THE PREFERRED EMBODIMENTS

Figure 1:
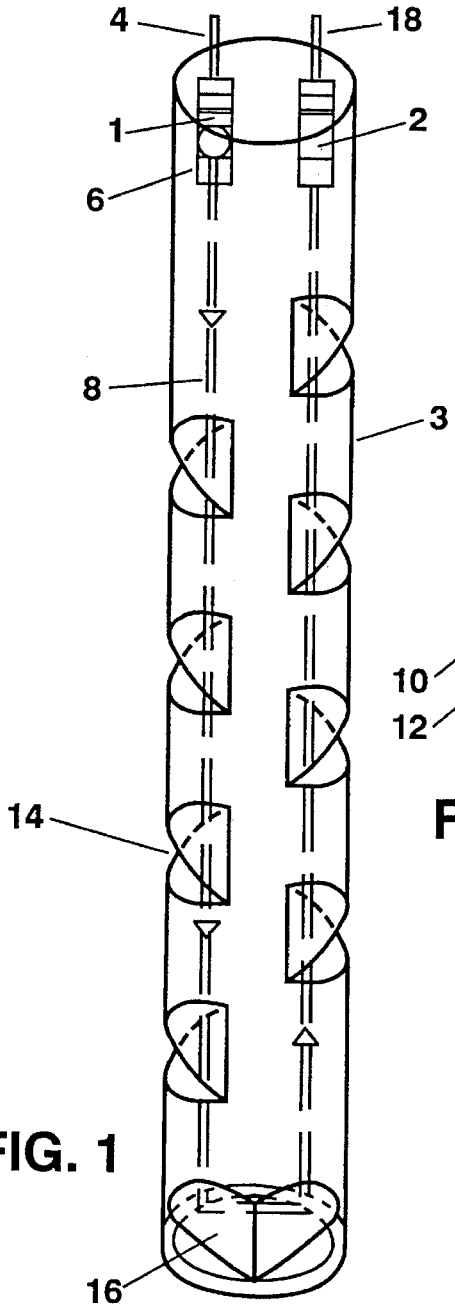
FIG. 1 is a perspective view of a first embodiment of the fire detector assembly with the light guide having angular notches.

Referring to FIG. 1, the fire detector fire detector of the present invention is shown as comprising a light source 1, a light sensor 2, and a clear plastic light guide 3. The light source 1 can be a visible or infrared light source, for example. DC or pulsed power can be supplied through terminal connector 4. A calibration sensor 6 is located next to the light source and is used to ensure that the light source is operational, as well as to provide a base signal for comparison by the light sensor 2. The light beam generated by light source 1 travels as shown by arrows 8 along the light guide 3.

The light beam passes through notches 14 cut into the light guide to allow intrusion of smoke into the light beam. Smoke particles which intrude into the light beam scatter the light, thereby reducing the intensity of light received by the light sensor 2.

Figure 4:
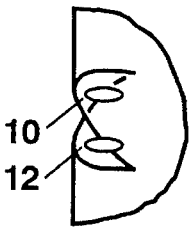
FIG. 4 is a detail view showing placement of a collimating lens assembly formed on the sides of a notch.

The fire detector optionally can be modified to increase the sensitivity of the detector by providing collimating lens assemblies to concentrate the beam of generated light. An illustrative example of such a lens assembly is shown in FIG. 4. Lenses 10 and 12 are mounted or formed in the side walls of notch 14.

The path travelled by the light beam may be increased in length by adding reflector 16 which directs the light back along the length of the light guide toward the light sensor 2.

When the light beam impinges on the light sensor 2, an analog output signal is generated. The output of the light sensor 2 is supplied through terminal connector 18 typically as a voltage which is a function of the amount of smoke present in the light beam. The amount of light is compared with the calibrating sensor 6. Thus, the amount of smoke intruding on the light beam is detected.

The two terminal connectors 4, 18 are designed to be connected to, for example, a data board, which interfaces with the light detector assembly to provide power and process signals generated by the detector assembly. Data boards receive information from the fire detector as part of the data-gathering capabilities of TWARSES (Two Wire Automatic Remote Sensing Evaluation System).

Additionally, the light source 1 of the fire detector of the present invention may be adapted to provide colored light, whereby the color of the smoke being detected is determined. Various methods of producing colored light may be used, including providing a colored filter between the light source and the detector. The filter may be divided to provide multiple color-segments. Detectors can be set up to determine which filter segment obstructs the most light, whereby a determination of the color of the smoke may be made.

Figure 2:
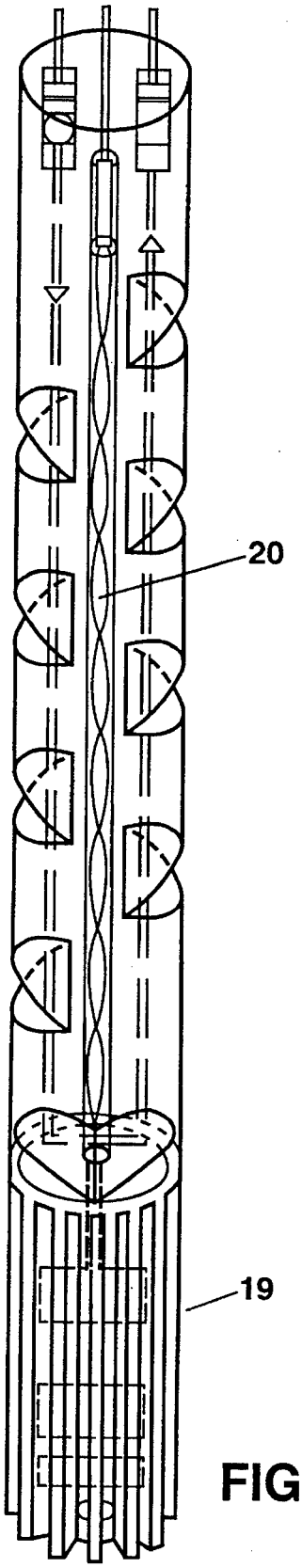
FIG. 2 shows the fire detector assembly of FIG. 1 including an end cage, the end cage containing humidity, temperature and CO sensors represented schematically, a collimating lens assembly, and a colored light source.

FIG. 2 shows the fire detector of the present invention with additional features. End section 19 comprises an open cage in which, for example, relative humidity, temperature and CO sensors of a known type may be enclosed within the end section to provide additional information to the detector. Typically, temperature will rise in a fire, while relative humidity will fall. Perhaps the first and most reliable indicator of a fire is the presence of CO. CO detectors can be coupled with the fire detector of the present invention through wires 20 to provide more complete fire information. The wires 20 can be fed through a hole drilled in the light guide, or molded into the light guide itself.

Figure 3:
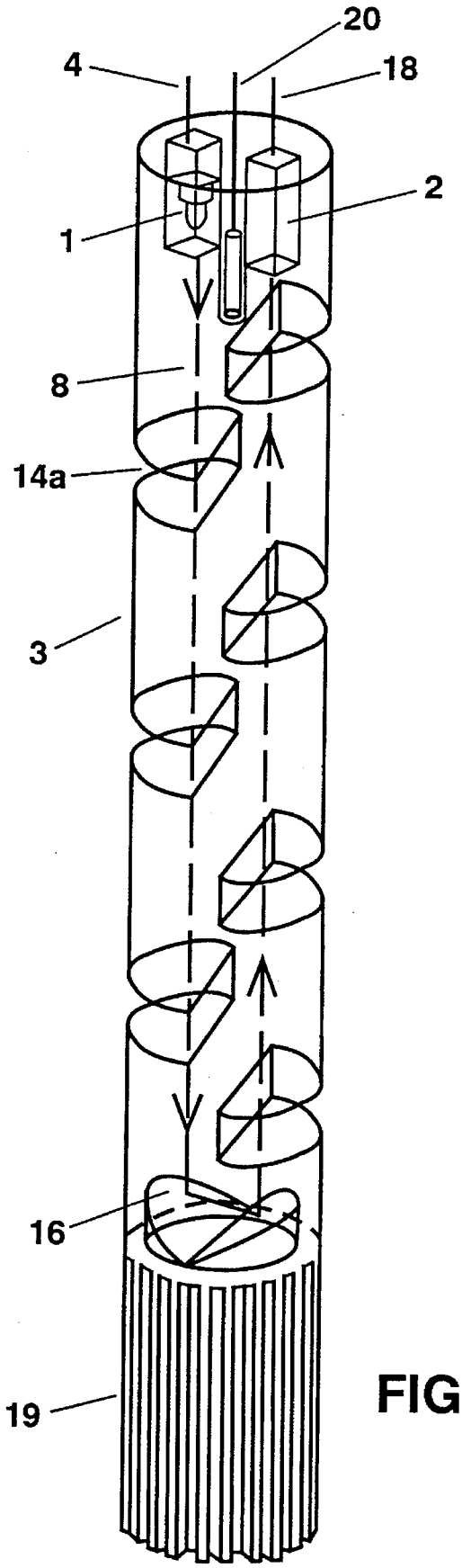
FIG. 3 shows an alternative embodiment of the fire detector assembly with the light guide having notches with parallel sides.

FIG. 3 shows an alternative embodiment of the present invention in which notches 14*a* are formed with parallel sides.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An apparatus for detecting the amount of smoke in an environment, comprising:

a slender, straight, enclosing light guide having a length, a first end and a second end, said light guide being unapertured along its length, said light guide including a first lengthwise linear array of notches and a second lengthwise linear array of notches, each said notch having two clear notch sides which provide therebetween an inwardly recessed interspace for said environment;

a light source, at said first end, for generating a light beam, said light beam having an initial light intensity, said light beam subsequently passing through said notch sides and said inwardly recessed interspaces of said first lengthwise array of notches;

a first reflector, at said second end, for reflecting said light beam which has previously passed through said notch sides and said inwardly recessed interspaces of said first lengthwise array of notches;

a second reflector, at said second end, for reflecting said light beam which has previously been reflected by said first reflector, said light beam subsequently passing through said notch sides and said inwardly recessed interspaces of said second lengthwise array of notches;

a light sensor, at said first end, for receiving said light beam, said light beam having previously passed through said notch sides and said inwardly recessed interspaces of said second lengthwise array of notches, said light beam having an attenuated light intensity, said light sensor generating an analog signal which indicates said attenuated light intensity, said initial light intensity having been reduced to said attentuated light intensity in proportion to the amount of said smoke through which said light beam has passed in said inwardly recessed interspaces of said first lengthwise array of notches and said second lengthwise array of notches.

2. The apparatus of claim 1, further comprising a calibration sensor for receiving said light beam of said initial light intensity and generating an analog signal which indicates said initial light intensity, thereby permitting calibration of said light sensor by comparison of said initial light intensity with respect to said attenuated light intensity.

3. The apparatus of claim 1, wherein said light source generates light selected from the group of light types consisting of infrared light and visible light.

4. The apparatus of claim 1, wherein said light source further comprises means for receiving electrical power.

5. The apparatus of claim 4, wherein said (the) means for receiving electrical power is for receiving (receives) DC power, such that said light beam generated by said (the) light source is steady.

6. The apparatus of claim 5, wherein said (the) means for receiving electrical power is for receiving (receives) pulsed power, such that said light beam generated by said (the) light source is pulsed.

7. The apparatus of claim 1, wherein each said notch has two said notch sides which are parallel to each other.

8. The apparatus of claim 1, wherein each said notch has two said notch sides which meet at a junctional edge of said notch sides so as to form an angle.

9. The apparatus of claim 1, further comprising at least one lens assembly for collimating said light beam generated by said light source, whereby the sensitivity of said apparatus is increased.

10. The apparatus of claim 9, wherein each said lens assembly includes two lenses, and each said notch is coupled with a said lens assembly whereby one said lens is coupled with one said notch side.

11. The apparatus of claim 1, further comprising means for determining a color of said smoke through which said light beam passes in said inwardly recessed interspaces of said first lengthwise array of notches and said second lengthwise array of notches.

12. The apparatus of claim 11, wherein said means for determining a color of said smoke comprises means, associated with said light source, for generating colored light.

13. The apparatus of claim 1, further comprising means for sensing properties of said environment which are selected from the group of properties consisting of relative humidity, ambient temperature and carbon monoxide level.

14. The apparatus of claim 1, further comprising:

at least one lens assembly for collimating said light beam generated by said light source; and a calibration sensor for receiving said light beam of said initial light intensity and generating an analog signal which indicates said initial light intensity, thereby permitting calibration of said light sensor by comparison of said initial light intensity with respect to said attenuated light intensity.

15. The apparatus of claim 14, wherein said light source generates light selected from the group of light types consisting of infrared light and visible light.

16. A device for sensing, and which can be suitably used for monitoring, the amount of smoke in an environs, said device comprising:

a hollow, slender, transparent member which is symmetrical with respect to an imaginary longitudinal axis and is impenetrable to smoke, said member having a first end, a second end, an exterior surface and an interior surface, said member having on opposite sides of said longitudinal axis a first axial alignment of depressions and a second axial alignment of depressions, each said depression having a recessed exterior surface area and a raised interior surface area, each said recessed exterior surface area defining an exterior interstice which smoke from said environs can enter;

a light source, located at said first end of said member, for emitting a light beam which travels in the axial direction toward said second end, along said first axial alignment of depressions, so as to hug said interior surface and traverse each said exterior interstice of said first axial alignment of depressions;

a dual reflector, located at said second end of said member, for redirecting said light beam to travel in the axial direction toward said first end, along said second axial alignment of depressions, so as to hug said interior surface and traverse each said exterior interstice of said second axial alignment of depressions; and a light sensor, located at said first end of said member, for providing analog signals corresponding to the intensity of said light beam, said analog signals being a function of the diminution of said intensity of said light beam, said diminution being a function of the amount of smoke from said environs which is present in said light beam in said exterior interstices.

17. A device for sensing the amount of smoke as in claim 16, wherein said light sensor is a first light sensor and further comprising a second light sensor, located proximate said light source, for providing analog reference signals corresponding to said intensity of said light beam in the absence of said diminution.

18. A device for sensing the amount of smoke as in claim 16, further comprising at least one pair of lenses, each said pair of lenses coupled with a said depression for collimating said light beam.

19. Apparatus for sensing the amount of atmospheric particles, comprising:

an elongated chamber which is surrounded by an exterior region and which surrounds an interior region, said chamber having a first end section, a second end section and a transparent continuous longitudinal section, said longitudinal section having a first longitudinally aligned series of inward indentations and a second longitudinally aligned series of inward indentations, said first series of indentations and said second series of indentations being substantially opposed, each said indentation having two indentation sides which bound a portion of said exterior region, said indentation sides longitudinally separating portions of said exterior region and said interior region;

a light source, positioned at said first end section, for emitting a light beam which will consecutively travel three substantially linear light paths, said light paths consecutively being a first longitudinal light path, a transverse light path and a second longitudinal light path, said first longitudinal light path passing through said indentation sides and said portions of said exterior region and said interior region along said first series of indentations, said second longitudinal light path passing through said indentation sides and said portions of said exterior region and said interior region along said second series of indentations;

a first obliquely angled reflector, positioned at said second end section, for reflecting said light beam which has traveled said first longitudinal light path so as to travel said transverse light path;

a second obliquely angled reflector, positioned at said second end section, for reflecting said light beam which has traveled said transverse light path so as to travel said second longitudinal light path; and a light sensor, positioned at said first end section, for measuring the intensity of said light beam which has traveled said second longitudinal light path, said intensity being a function of the amount of atmospheric particles in said exterior region which have entered said light beam at said portions of said exterior region while said light beam has traveled said first longitudinal light path and said second longitudinal light path.

20. Apparatus for sensing the amount of smoke as in claim 19, wherein said light sensor is a first light sensor and further comprising a second light sensor, located near said light source, for measuring the intensity of said light beam in said first longitudinal light path before said light beam has reached a said indentation side.

* * * * *